United States Patent [19]

Nagamoto

[11] Patent Number: 4,795,159

[45] Date of Patent: Jan. 3, 1989

[54] WOOD-TYPE GOLF CLUB HEAD

[75] Inventor: Itsushi Nagamoto, Shizuoka, Japan

[73] Assignee: Yamaha Corporation, Japan

[21] Appl. No.: 70,958

[22] Filed: Jul. 8, 1987

[30] Foreign Application Priority Data

Jul. 11, 1986 [JP] Japan ..... 61-106338

[51] Int. Cl.[4] ..... A63B 53/06; A63B 53/08

[52] U.S. Cl. ..... 273/171; 273/172; 273/174

[58] Field of Search ..... 273/167 H, 172, 174, 273/171, 167 A, 167 F, 169, 173, 167 R

[56] References Cited

U.S. PATENT DOCUMENTS 4,535,990 8/1985 Yamada ..... 273/167 H 4,714,577 12/1987 Nagamoto et al. ..... 273/167 H

*Primary Examiner*—George J. Marlo

*Attorney, Agent, or Firm*—Lerner, David, Littenberg, Krumholz & Mentlik

[57] ABSTRACT

A hollow golf club head made from fiber reinforced plastic is provided with a sole plate of composite construction. The sole plate includes an inner resin block interengaged with an outer metal layer. A projection on the resin block extends upward into an opening in the bottom surface of the club head. An aperture passes through the center of the sole plate and through a nut embedded in the resin block. A threaded bolt is screwed into the embedded nut for weight adjustment.

18 Claims, 2 Drawing Sheets

WOOD-TYPE GOLF CLUB HEAD

BACKGROUND OF THE INVENTION

The present invention relates to an improved wood-type golf club head, and more particularly relates to an improvement in mechanical property of a wood-type golf club head having an fiber reinforced plate (FRP) shell.

In the construction of a conventional club head of this type, a metallic sole plate is attached via screws to the sole face of the FRP shell. Alternatively, a sole plate may be inserted into and fixed to a local recess formed in the sole face of the FRP shell. In either case, the sole plate is used for the purposes of weight adjustment and/or protection of the FRP shell.

With such conventional constructions, fixing by screws cannot endure repeated application of impulsive force which acts on the sole plate when driving balls, thereby causing accidental separation of the sole plate during long use. Even when long screws are used for fixing the sole plate, the relatively thin construction of the FRP shell cannot assure reliable fixing of the sole plate during long use.

When a large hole exists in the FRP shell due to requirement in production, at least the part of the FRP shell has to be covered with a metallic sole plate for reinforcement. Such local covering by the sole plate, however, develops shearing force in the plane of contact of the sole plate with the FRP shell and, as a consequence, appreciable effect of reinforcement by the sole plate cannot be expected.

When a sole plate is received in a recess in the sole face of the FRP shell, the construction may well withstand the above-described impulsive force. However, this construction cannot provide full protection over the entire sole face and the peripheral section of the sole face of the FRP shell is left out of the protection by the sole plate. When a metallic sole plate covers the entire sole face of the FRP shell, resultant excessive total weight of the club head disenables free design of weight adjustment.

SUMMARY OF THE INVENTION

It is the object of the present invention to raise impulsion resistance of a wood-type golf club head, and prevent accidental separation of the sole plate.

In accordance with the present invention, an FRP shell is provided with a recess formed in its sole face, a sole plate is made of an outer, metallic substrate and an inner synthetic resin block attached to the substrate and the synthetic resin block is provided with an inner projection to be snugly received in the recess in the FRP shell.

DESCRIPTION OF THE PREFERRED EMBODIMENTS

Figure 1:
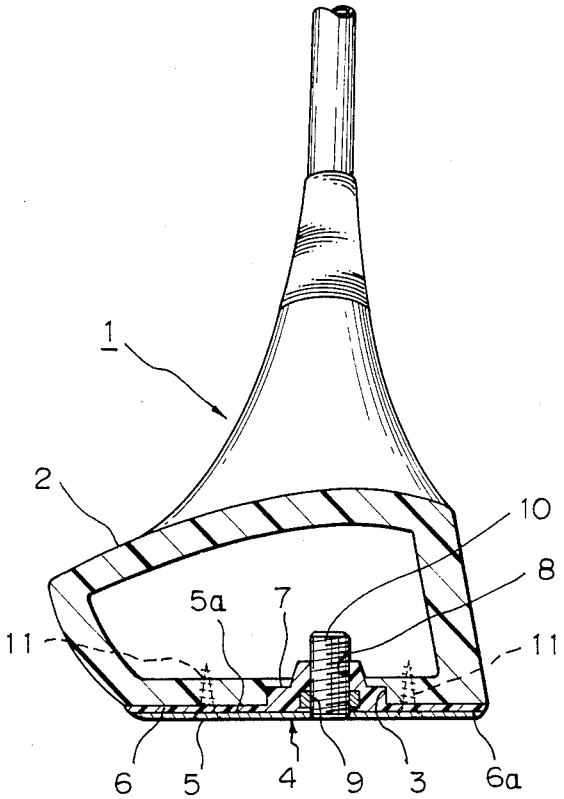
FIG.1 is a side sectional view of one embodiment of the golf club head in accordance with the present invention.
Figure 2:
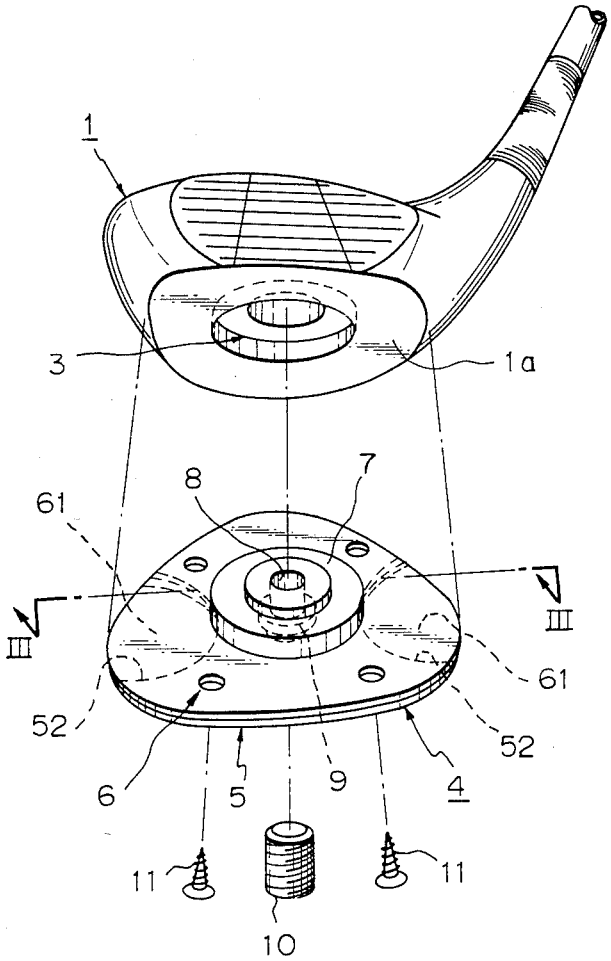
FIG. 2 is a perspective view of the golf club head shown in FIG. 1 in a disassembled state.

One embodiment of the golf club head in accordance with the present invention is shown in FIGS. 1 and 2, in which a head main body 1 has a cavitious construction including an FRP shell 2. Alternatively, the cavity of the head main body 1 may be filled with a core made of, for example, foam synthetic resin. The head main body 1 has a front wall forming an impact face for driving golf balls, and a bottom surface. In the center part of the sole face 1*a* of the head main body 1, a recess 3 is formed in the FRP shell 2. The recess 3 may be either closed in its inner end or formed through the FRP shell 2. In the case of the illustrated example, a circular recess 3 is formed. The sole face 1*a* is entirely covered with a sole plate 4.

Figure 3:
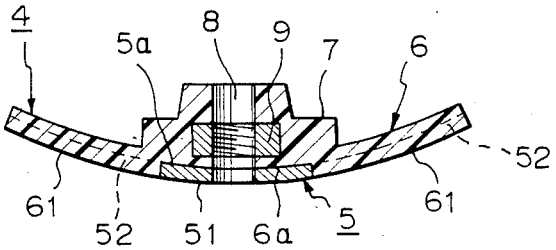
FIG. 3 is a section taken along a line III—III in FIG. 2.

As best seen FIG. 3, the sole plate 4 includes an outer substrate 5 made of metallic material such as brass or A1-base alloys. A synthetic resin block 6 is attached to the inner face 5*a* of the substrate 5. In this composite construction of the sole plate 4, the substrate 5 surves mainly for protection of the sole face 1*a* and weight adjustment of the head main body 1. The synthetic resin block 6 is provided with an inner projection 7 which is shaped to be snugly received in the recess 3 in the FRP shell 2.

On both sides in the driving direction of the center part 51 of the substrate 5 substantially perpendicular to the front wall impact face, are formed a pair of substantially semicircular cutouts 52 which snugly receive semicircular outer projections 61 formed on the outer face 6*a* of the synthetic resin block 6 so that the synthetic resin block 6 should extend in the driving direction astride and even with the substrate 5, substantially perpendicular to the front wall impact face, A through hole 8 is formed in the sole plate 4 at a position corresponding to the center part of the inner projection 7 of the synthetic resin block 6 and an anchor nut 9 is embedded in the synthetic resin block 6 concentrically with the through hole 8. For weight adjustment, a mass 10 in the form of a threaded bolt is screwed into the anchor nut 9.

In assemblage of the golf club head, the sole plate 4 is attached to the sole face 1*a* of the head main body 1 with the projection 7 of the synthetic resin block 6 in the recess 3 in the FRP shell 2 and such an attachment is fixed by proper bonding or use of small set screws 11.

For preparation of the FRP shell, combined layers of reinforcing fibers are impregnated with prepreg or liquid synthetic resin and the impregnated, combined layers are subjected to shaping by hardening.

Such a layered combination of reinforcing fiber preferably includes an outer layer made of a surface mat or a satin woven cloth solely or combined with a hollow woven cloth for the purpose of surface smoothness and/or better fidelity to moulds at shaping. For an inner layer of the layered combination is a mat or a hollow woven cloth of carbon fibers preferably used to raise elastic nature of the product.

Although the inner projection 7 of the synthetic resin block 6 may take any configurations other than a cylinder, the cylindrical configuration well avoid stress concentration at impact when driving balls. The cutouts 52 and the projections 61 may take any shape other than the semicircular as long as they can be combined snugly. However, just as in the case of the inner projection 7, the semicircular shape can well avoid stress concentration at impact when driving balls.

In accordance with the present invention, the sole plate has a composite construction made up of the metal substrate and the synthetic resin block combined firmly to each other. At impact when driving balls, the substrate moves in the driving direction. However, the synthetic resin block follows the movement of the substrate, preventing separation at the substrate border from the driving force at impact. The recess and other possible holes in the FRP shell are fully closed by the synthetic resin block, which thereby strengthens the FRP shell. The presence of the synthetic resin block adequately strengthens the sole plate even when the FRP shell has a thin construction.

I claim:

1. A golf club head comprising a fiber reinforced plastic shell, said shell including a front wall forming an impact face, and a bottom surface including a recess, and a sole plate attached to said bottom surface of said shell, said sole plate comprising an outer metallic substrate having top and bottom surfaces and an inner resin block substrate having top and bottom surfaces, said bottom surface of said inner resin block substrate being attached to said top surface of said outer metallic substrate, and said top surface of said inner substrate resin block including an integral projection snugly fitting into said recess in said bottom surface of said shell so as to firmly anchor said sole plate in said shell.

2. The golf club head of claim 1 wherein said inner resin block substrate covers substantially the entire area of said bottom of said shell.

3. The golf club head of claim 1 wherein at least a portion of said outer metallic substrate includes at least one cutout portion, and wherein said inner resin block substrate includes projection means corresponding to said at least one cutout portion, said projection means including a surface portion corresponding to said bottom surface of said outer metallic substrate.

4. The golf club head of claim 3 wherein said at least one cutout portion includes first and second cutout portions, and wherein said projection means includes corresponding first and second projection members.

5. The golf club head of claim 4 wherein said first and second output portions are located on opposite sides of said outer metallic substrate with respect to a direction extending substantially perpendicular to said front wall of said shell.

6. The golf club head of claim 5 wherein each of said first and second cutout portions and said first and second projection members have corresponding semi-circular shapes.

7. The golf club head of claim 1, wherein said integral projection of said inner resin block substrate is cylindrical.

8. The golf club head of claim 7, wherein said cylindrical integral projection of said inner resin block substrate includes a through-hole and amass for weight adjustment snugly fitted in said through-hole.

9. The golf club head of claim 8 wherein said comprises an anchor nut embedded in said inner resin block substrate concentrically with said through-hole and a threaded bolt engaged with said anchor nut.

10. A golf club head comprising a fiber-reinforced plastic shell, said shell including a front wall forming an impact face and a bottom surface, and a sole plate attached to said bottom surface of said shell, said sole plate comprising an outer metallic substrate having top and bottom surfaces, and an inner resin block substrate having top and bottom surfaces, said bottom surface of said inner resin block substrate being attached to said top surface of said outer metallic substrate, at least a portion of said outer metallic substrate including at least one cutout portion, and said inner resin block substrate including projection means corresponding to said at least one cutout portion, said projection means including a surface portion corresponding to said bottom surface of said outer metallic substrate.

11. The golf club head of claim 10, wherein said inner resin block substrate covers substantially the entire area of said bottom of said shell.

12. The golf club head of claim 10, wherein said plastic shell bottom surface includes a recess, said top surface of said inner substrate resin block includes an integral projection and said integral projection snugly fits into said recess in said bottom surface of said shell so as to firmly anchor said sole plate in said shell.

13. The golf club head of claim 12, wherein said integral projection of said inner resin block substrate is cylindrical.

14. The golf club head of claim 13, wherein said cylindrical inner projection of said inner resin block substrate includes a through-hole and a mass for weight adjustment snugly fitted in said through-hole.

15. The golf club head of claim 14, wherein said mass comprises an attachment embedded in said inner resin block substrate concentrically with said through-hole and a threaded bolt engaged with said anchor nut.

16. The golf club head of claim 10 wherein said at least one cutout portion includes first and second cutout portions, and wherein said projection means includes corresponding first and second projection means.

17. The golf club head of claim 16 wherein said first and second cutout portions are located on opposite sides of said outer metallic substrate with respect to a direction extending substantially perpendicular to said front wall of said shell.

18. The golf club head of claim 17 wherein each of said first and second cutout portions and said first and second projection members have corresponding semi-circular shapes.

* * * * *

UNITED STATES PATENT AND TRADEMARK OFFICE

CERTIFICATE OF CORRECTION

PATENT NO. : 4,795,159

DATED : January 3, 1989

INVENTOR(S) : Itsushi Nagamoto

It is certified that error appears in the above-identified patent and that said Letters Patent is hereby corrected as shown below:

Column 1, line 5, "plate" should read --plastic--.

Signed and Sealed this

Eleventh Day of July, 1989

*Attest:*

DONALD J. QUIGG

*Attesting Officer*

*Commissioner of Patents and Trademarks*